US008823473B2

(12) United States Patent
Fujita et al.

(10) Patent No.: US 8,823,473 B2
(45) Date of Patent: Sep. 2, 2014

(54) LATCHING RELAY

(75) Inventors: Ken Fujita, Kounosu (JP); Shota Kikuchi, Kounosu (JP); Noriyoshi Machida, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/885,310

(22) PCT Filed: Nov. 24, 2011

(86) PCT No.: PCT/JP2011/077028

§ 371 (c)(1),
(2), (4) Date: May 14, 2013

(87) PCT Pub. No.: WO2012/073780

PCT Pub. Date: Jun. 7, 2012

(65) Prior Publication Data

US 2013/0229246 A1 Sep. 5, 2013

(30) Foreign Application Priority Data

Nov. 30, 2010 (JP) ..... 2010-266732
Jun. 3, 2011 (JP) ..... 2011-125262

(51) Int. Cl.

| | |
|---|---|
| ***H01H 3/00*** | (2006.01) |
| ***H01H 9/00*** | (2006.01) |
| ***H01H 51/27*** | (2006.01) |
| ***H01H 50/18*** | (2006.01) |
| ***H01H 50/24*** | (2006.01) |
| ***H01H 51/22*** | (2006.01) |
| *H01H 50/64* | (2006.01) |

(52) U.S. Cl.

CPC ..... *H01H 50/18* (2013.01); *H01H 51/27* (2013.01); *H01H 50/641* (2013.01); *H01H 50/24* (2013.01); *H01H 51/2263* (2013.01)

USPC ..... 335/189; 335/128; 335/181

(58) Field of Classification Search

CPC ..... H01H 51/00; H01H 51/04; H01H 51/06; H01H 51/12; H01H 51/22; H01H 51/2236; H01H 51/2272; H01H 50/18; H01H 50/24; H01H 50/58; H01F 7/08; H01F 7/14; H01F 7/1646; H01F 2007/086; H01F 2007/1669

USPC ..... 335/78–86, 128, 196, 198, 158, 189, 335/181

See application file for complete search history.

(56) References Cited

U.S. PATENT DOCUMENTS

| | | | | |
|---|---|---|---|---|
| 6,020,801 | A * | 2/2000 | Passow | 335/78 |
| 6,426,689 | B1 * | 7/2002 | Nakagawa et al. | 335/78 |
| 7,642,884 | B2 * | 1/2010 | Bergh et al. | 335/78 |

(Continued)

FOREIGN PATENT DOCUMENTS

| | | | |
|---|---|---|---|
| JP | S55-62636 | A | 5/1980 |
| JP | H01-136312 | A | 5/1989 |

(Continued)

*Primary Examiner* — Bernard Rojas
(74) *Attorney, Agent, or Firm* — Manabu Kanesaka

(57) ABSTRACT

A latching relay has a fixed iron core including an exciting coil wound around an intermediate portion and a magnetic pole piece at two ends; movable iron pieces sandwiching a permanent magnet between two bar-shaped iron pieces disposed in parallel with each other, and are fixed with a holder; and a switchable electrical contact portion. The fixed iron core and the movable iron pieces are disposed facing each other to insert each of the magnetic pole pieces on two sides of the fixed iron core to be spaced apart in a space between the two bar-shaped iron pieces of two end portions of the movable iron pieces. The movable iron pieces are supported pivotally in a direction in which the two bar-shaped iron pieces are aligned. The movable iron pieces are linked to the electrical contact portion, and the movable iron pieces perform a switching of the electrical contact portion.

4 Claims, 18 Drawing Sheets

(56) References Cited

U.S. PATENT DOCUMENTS

| | | | | |
|---|---|---|---|---|
| 7,889,032 | B2 * | 2/2011 | Parker et al. | 335/78 |
| 8,502,627 | B1 * | 8/2013 | Ahmad et al. | 335/80 |
| 2009/0033447 | A1 * | 2/2009 | Gruner et al. | 335/189 |

FOREIGN PATENT DOCUMENTS

| | | | |
|---|---|---|---|
| JP | H04-349323 | A | 12/1992 |
| JP | 2009-199732 | A | 9/2009 |
| JP | 2009-259612 | A | 11/2009 |

* cited by examiner

LATCHING RELAY

RELATED APPLICATIONS

The present application is National Phase of International Application No. PCT/JP2011/077028 filed Nov. 24, 2011, and claims priority from Japanese Application No. 2010-266732, filed Nov. 30, 2010, and No. 2011-125262, filed Jun. 3, 2011.

TECHNICAL FIELD

The present invention relates to a latching relay arranged in such a way as to control switching of electrical contacts by energizing an electromagnet, and after the energization is stopped, retain a switched state with the magnetic force of a permanent magnet.

BACKGROUND ART

As shown in Patent Document 1, this kind of latching relay is arranged in such a way that DC forward and reverse currents are alternately caused to flow through an exciting coil of an electromagnet, and both ends of a movable iron piece alternately contact with the magnetic pole surface of each end of a fixed iron core, thereby causing the movable iron piece to make a reversal movement, and causing the reversal movement of the movable iron piece to switch electrical contacts. Further, the latching relay is arranged in such a way that a condition in which the movable iron piece is attracted to the magnetic pole surface of the fixed iron core is maintained by the magnetic force of the permanent magnet when the energization of the exciting coil is stopped to non-excite the electromagnet, thereby retaining a switched state of the electrical contacts.

This kind of heretofore known latching relay 100 comprises an electromagnet portion 110, a movable iron piece portion 120, a movable contact portion 130, a fixed contact portion 140, and the like, as shown in FIG. 19. The individual portions are assembled in advance into blocks, and disposed on a base member 102 formed from an insulating resin. Also, the movable iron piece portion 120 and movable contact portion 130 are linked via a sliding member 150. These members, after being disposed on the base member 102, are covered with a cover member.

The electromagnet portion 110 comprises a substantially U-shaped fixed iron core 111, a coil bobbin 112 insert molded integrally with the fixed iron core 111, an exciting coil 113 wound around the coil bobbin 112, and the like, as shown simplified in FIGS. 20(A), 20(B). Both ends of the exciting coil 113 are connected to a coil terminal 114. Also, an auxiliary yoke 122 bridged between magnetic pole pieces 111*a* and 111*b* formed of two respective legs of the fixed iron core 111 of the electromagnet portion 110 is provided between the magnetic pole pieces 111*a* and 111*b*.

Also, the movable iron piece portion 120 comprises a substantially rectangular parallelepiped permanent magnet 121, an auxiliary yoke 122 to which the permanent magnet 121 is fixed, a movable iron piece 124 pivotally supported on the permanent magnet 121 via a pivotal support mechanism 123 (refer to FIG. 19), and the like, as shown simplified in FIGS. 20(A), 20(B).

The movable iron piece 124 is a substantially rectangular plate-like body formed by pressing, for example, a soft magnetic iron plate, and has a fulcrum protruding portion 124*a* formed in a substantially central portion of a surface facing the permanent magnet 121 so as to protrude to the permanent magnet 121 side (refer to FIGS. 20(A), 20(B)).

The permanent magnet 121 is disposed so that, for example, the auxiliary yoke 122 side is the N-pole, and the movable iron piece 124 side is the S-pole. When the movable iron piece portion 120 is assembled, the permanent magnet 121 is disposed so as to be sandwiched between the auxiliary yoke 122 and movable iron piece 124. As shown by the dashed arrows in FIG. 20(A), a magnetic flux emitted from the N-pole of the permanent magnet 121 passes through the auxiliary yoke 122, the magnetic pole piece 111*a* of the fixed iron core 111 attracting one end of the movable iron piece 124 with the excitation of the exciting coil 113, the movable iron piece 124, and the fulcrum protrusion 124*a*, and returns to the S-pole of the permanent magnet 121.

A condition in which the movable iron piece 124 is magnetically attracted by the fixed iron core 111 is maintained by this kind of magnetic action caused by the magnetic flux of the permanent magnet 121 even after the energization of the exciting coil 113 is stopped to switch the electromagnet 110 to a non-excited state.

The movable contact portion 130 is comprises a movable terminal 131 formed by bending a metal plate in a predetermined shape, a movable contact spring 132 formed of a spring sheet metal, a metal movable contact 133 fixed to the spring 132, and the like. Furthermore, a protruding portion 132*a* engaged with the sliding member 150 is formed at the leading end of the movable contact spring 132. Also, the fixed contact portion 140 is formed by bending a spring sheet metal in a predetermined shape, and configured of a fixed terminal plate 142 having a fixed terminal 141, a metal fixed contact 143, and the like.

A switching operation of the electrical contacts in this kind of latching relay 100 is as follows.

The condition of FIG. 19 is a condition in which the electrical contacts are in an off state. In this condition, as the upper end side of the movable iron piece 124 is magnetically attracted to the upper side magnetic pole piece 111*a* of the fixed iron core 111 by the magnetic flux of the permanent magnet 121 passing as shown by the dashed arrows in FIG. 20(A), the movable contact spring 132 is pulled to the electromagnet portion 110 side by the movable iron piece 124 via the sliding member 150, and the movable contact 133 separates from the fixed contact 143, meaning that the electrical contacts switch to the off state.

Herein, when an exciting current of a polarity which generates a downward magnetic flux is passed through the exciting coil 113, as shown by the solid arrow in FIG. 20(A), a magnetic attraction force is generated between the lower end portion of the movable iron piece 124 and the lower side magnetic pole piece 111*b* of the fixed iron core 111, and a magnetic repulsion force is generated between the upper end portion of the movable iron piece 124 and the upper side magnetic pole piece 111*a* of the fixed iron core 111, which contact with each other, meaning that the movable iron piece 124 pivots clockwise with the fulcrum protrusion portion 124*a* as its pivot fulcrum, and switches to the kind of condition shown in FIG. 20(B). As a result of this, the sliding member 150 linked to a protruding piece 124*c* of the upper end of the movable iron piece 124 is pushed in the direction of the movable contact spring 132. By so doing, the movable contact spring 132 linked to the other end of the sliding member 150 moves toward the fixed terminal plate 142, and the movable contact 133 fixed to the movable contact spring 132 contacts with the fixed contact 143 of the fixed terminal plate 142, thus switching the contacts to the on state.

As no more magnetic flux is formed by the electromagnet when the exciting current of the coil 113 is stopped, the magnetic attraction force of the lower side magnetic pole piece 111*b* of the fixed iron core 111 on the movable iron piece 121 becomes weaker. However, as a magnetic flux generated by the permanent magnet 121 passes through a closed magnetic path from the N-pole of the permanent magnet 121 through the auxiliary yoke 122 and movable iron piece 124 back to the S-pole of the permanent magnet 121, as shown by the dashed arrows in FIG. 20(B), the attraction of the lower end portion of the movable iron piece 124 to the lower side magnetic pole piece 111*b* of the fixed iron core 111 is maintained by the magnetic force caused by the magnetic flux, and the on state of the electrical contacts is retained.

In this condition, when the electromagnet is excited by causing a current of a direction opposite the heretofore described direction to flow through the exciting coil 113 so that an upward magnetic flux is generated, as shown by the solid arrow in FIG. 20(B), the upper side magnetic pole piece 111*a* of the fixed iron core 111 takes on a magnetic polarity which attracts the upper end portion of the movable iron piece 124, while the lower side magnetic pole piece 111*b* takes on a magnetic polarity which repulses the movable iron piece 124, and the upper end of the movable iron piece 124 is attracted to the upper side magnetic pole piece 111*a*. By so doing, the movable iron piece 124 pivots in a counterclockwise direction with the fulcrum protruding portion 124*a* as its pivotal fulcrum, and switches to the condition shown in FIG. 17(A). As a result of this, the sliding member 150 linked to the protruding piece 124*c* of the movable iron piece 124 moves in a direction away from the movable contact spring 132, thus causing the movable contact spring 132 linked to the other end of the sliding member 150 to move away from the fixed terminal plate 142. By so doing, the movable contact 133 of the movable contact spring 132 separate from the fixed contact 143 of the fixed terminal plate 142, and the electrical contacts switch to the off state.

As no magnetic flux is generated by the electromagnet when the exciting current of the exciting coil 113 is stopped, the magnetic attraction force of the upper side magnetic pole piece 111*a* on the movable iron piece 124 becomes weaker, but the magnetic force of the permanent magnet 121 acts, meaning that a condition in which the upper end portion of the movable iron piece 124 is in abutment with the upper side magnetic pole piece 111*a* of the fixed iron core 111 is maintained, thus retaining the electrical contacts in the off state.

In this way, with the latching relay 100, it is possible to switch the switching condition of the electrical contacts by switching the polarity of the exciting current passed through the exciting coil 113 of the electromagnet portion 110, and it is possible to retain a switched state of the electrical contacts with the permanent magnet even when the exciting current is stopped.

CITATION LIST

Patent Literature

PTL 1: JP-A-2009-199732

SUMMARY OF INVENTION

Technical Problem

The previously described kind of heretofore known latching relay adopts a structure wherein a fulcrum for the pivotal movement of the movable iron piece of the electromagnet is supported by the permanent magnet. Because of this, the latching relay is of a structure wherein the fixed iron core around which the exciting coil is wound, the auxiliary yoke holding the permanent magnet, the permanent magnet, and the movable iron piece are aligned to be stacked one on another on the same axis, and there is a problem in that the whole dimension of the electromagnet of the latching relay becomes larger.

Also, the latching relay is used for a kind of purpose of closing the electrical contacts and continuously energizing a control circuit for a certain long period. For this kind of purpose, it may happen that the electrical contacts switch improperly due to a large mechanical vibration or impact being applied to the relay. In order to cause the relay to carry out a stable retaining operation without an occurrence of this kind of malfunction, it is good to increase the magnetic attraction force of the electromagnet portion, including the permanent magnet, but it is necessary to increase the size of the electromagnet portion, including the permanent magnet, when attempting to obtain a large magnetic attraction force from the electromagnet portion, meaning that the dimension of the electromagnet portion becomes larger, thus hindering a reduction in size of the latching relay.

The invention, in order to solve the kinds of problem previously mentioned, has an object of enabling the use of a small electromagnet portion, thus achieving a reduction in size of a latching relay.

Solution to Problem

In order to solve the previously described problem, the invention comprises a substantially C-shaped fixed iron core having an exciting coil wound around an intermediate portion thereof, and a magnetic pole piece at each end; movable iron pieces which sandwich a permanent magnet in a central portion between two bar-like iron pieces spaced apart from and disposed in parallel with each other, and are integrally held and fixed by a holder made from an insulating resin; and a switchable electrical contact portion. Magnetic pole pieces are each formed at each of the horizontally extended magnetic pole pieces of the respective upper and lower ends of the fixed iron core. Each of the magnetic pole piece extends shortly in an up-down direction and formed by bending the leading ends of the fixed iron core inward so as to face each other, The movable iron pieces are disposed in a space between the facing magnetic pole pieces extending shortly in the up-down direction, so that the leading ends of the magnetic pole pieces extending shortly in the up-down direction are set in respective spaces between upper end portions and between lower end portions of the two bar-like iron pieces of the movable iron pieces. The movable iron pieces are supported pivotally in a direction in which the two bar-like iron pieces are aligned, and the movable iron pieces are linked to the electrical contact portion, thus causing the movable iron pieces to carry out a switching of the electrical contact portion.

Also, in the invention, it is preferable that inclined surfaces are provided partially on at least either surfaces of the fixed iron core facing the movable iron pieces or surfaces of the movable iron pieces facing the fixed iron core.

Advantageous Effects of Invention

According to the invention, as a configuration is adopted wherein the permanent magnet is sandwiched between the two bar-shaped iron pieces configuring the movable iron pieces of the electromagnet portion of the latching relay, it is possible to maintain the dimension of the electromagnet portion even when the permanent magnet is increased in size, and thus possible to reduce the latching relay to a small size.

BRIEF DESCRIPTION OF DRAWINGS

FIGS. 17(A)-17(C) show a configuration of an electromagnet portion used in the latching relay of a fifth embodiment of the invention, wherein FIG. 17(A) is a front view, FIG. 17(B) is a plan view, and FIG. 17(C) is a side view.

DESCRIPTION OF EMBODIMENTS

Figure 1:
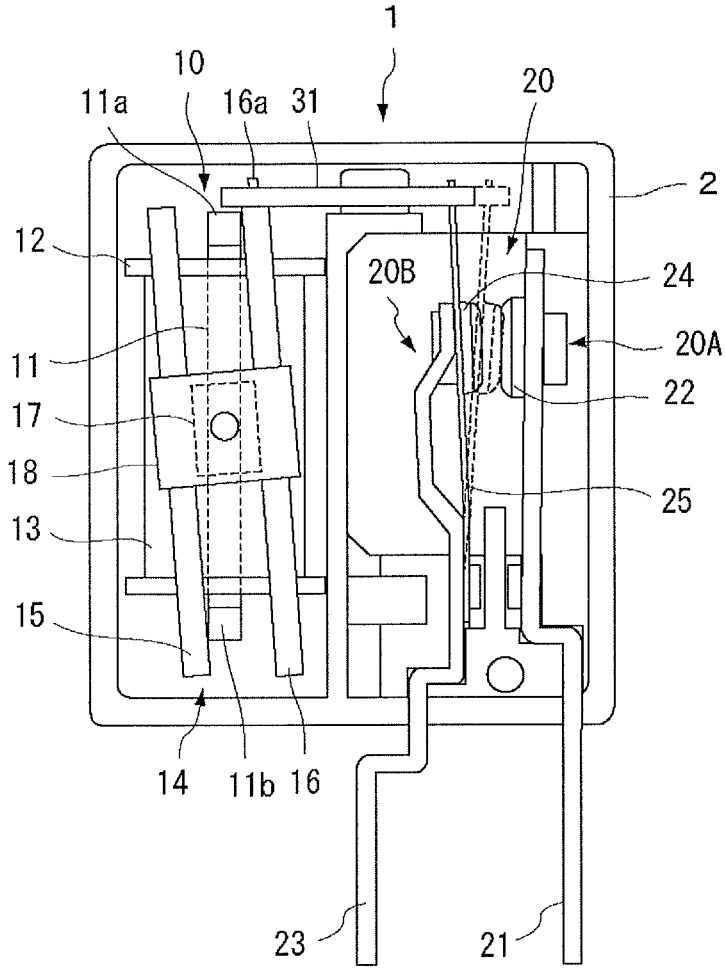
FIG. 1, showing a first embodiment of the invention, is a front view of a latching relay with a cover removed therefrom.

A description will be given of an embodiment of the invention with embodiments illustrated in the drawings.

First Embodiment

FIGS. 1 to 5 show a latching relay according to the first embodiment of the invention.

In FIGS. 1 to 5, numeral 1 is a latching relay, which includes an electromagnet portion 10 and an electrical contact portion 20, and is housed in a case 2 configured from an insulating resin.

Figure 2:
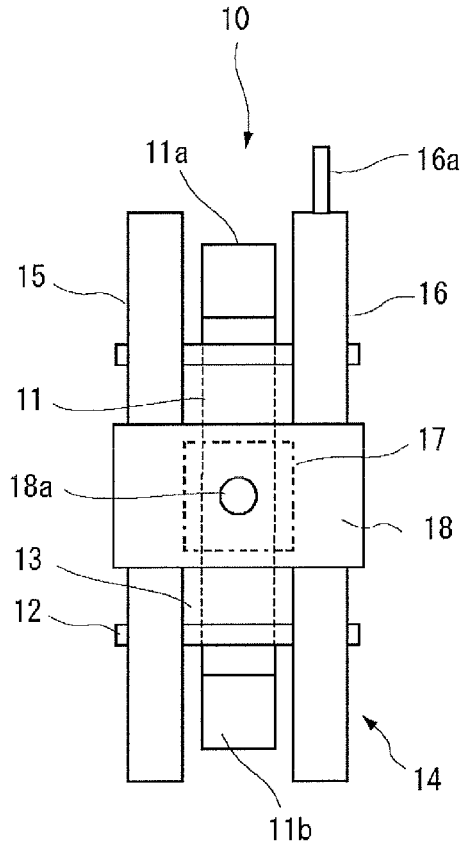
FIG. 2 is a front view of an electromagnet portion used in the latching relay of the first embodiment of the invention.
Figure 3:
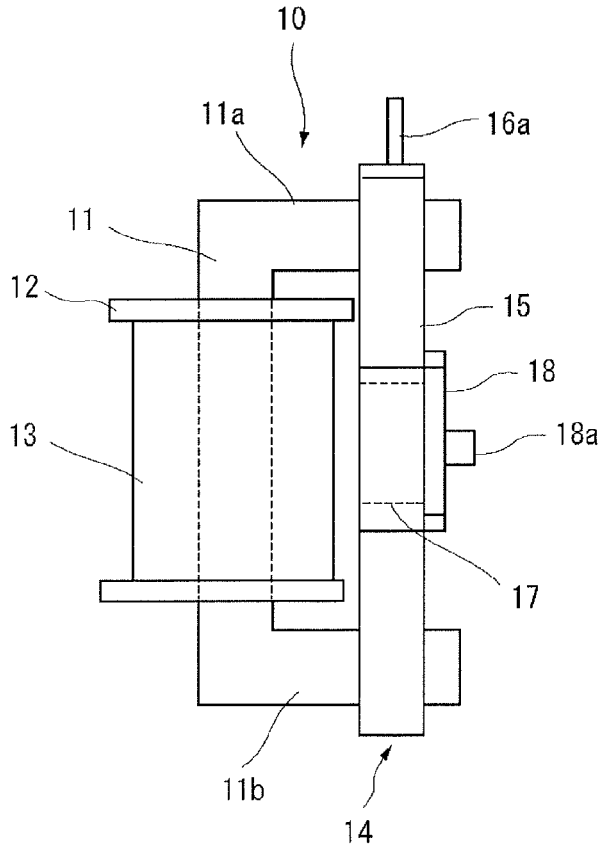
FIG. 3 is a side view of the electromagnet portion used in the latching relay of the first embodiment of the invention.

As shown in FIGS. 2 and 3, the electromagnet portion 10 includes a fixed iron core 11, on which is mounted an exciting coil 13 wound around a coil bobbin 12, and movable iron pieces 14 which make a reversal switching movement by being attracted by the fixed iron core 11.

The fixed iron core 11 is configured of an iron core, formed in a substantially U shape, which includes horizontally extended magnetic pole pieces 11*a* and 11*b* at the upper and lower ends.

Figure 4:
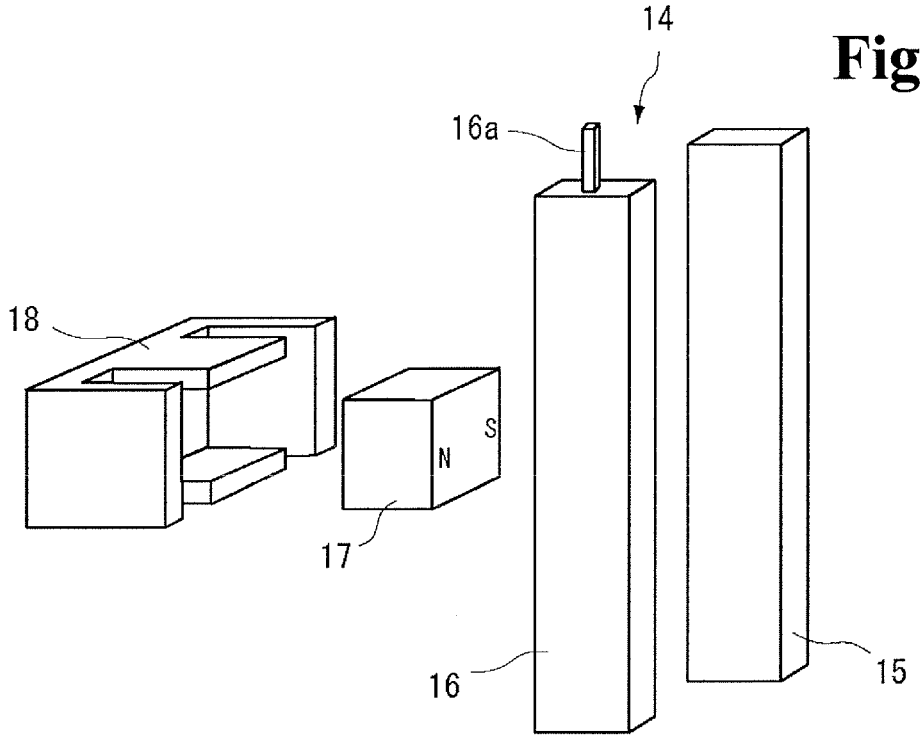
FIG. 4 is a perspective view showing, in exploded form, movable iron pieces of the electromagnet portion used in the latching relay of the first embodiment of the invention.
Figure 5:
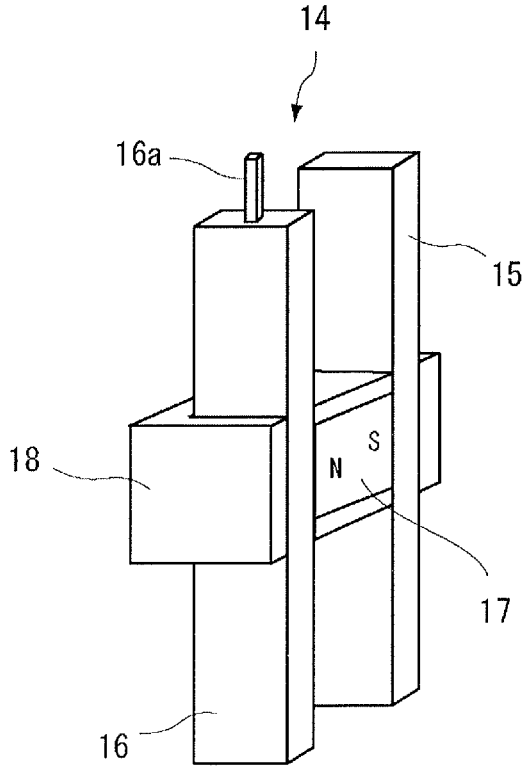
FIG. 5 is a perspective view showing an assembled condition of the movable iron pieces of the electromagnet portion used in the latching relay of the first embodiment of the invention.

Also, as shown in FIGS. 4 and 5, the movable iron pieces 14 include two I-shaped bar-shaped iron pieces 15 and 16 spaced apart from and disposed in parallel with each other and a rectangular parallelepiped permanent magnet 17 sandwiched in a central portion between the iron pieces 15 and 16. The iron pieces 15 and 16 and permanent magnet 17 are integrally held and fixed by being fitted into a holder 18 configured from an insulating resin, as shown in FIG. 5. An engagement piece 16*a* for a linkage with the electrical contact portion 20 is formed at the leading end of one iron piece 16. A support shaft 18*a* for pivotally supporting the movable iron pieces 14 is provided in a central portion of the holder 18 (refer to FIGS. 2 and 3).

The movable iron pieces 14 configured in this way are housed in the case 2, disposed facing the fixed iron core 11 so that the magnetic pole pieces 11*a* and 11*b* of the respective ends of the fixed iron core 11 are inserted in a space between the two iron pieces 15 and 16, as shown in FIGS. 2 and 3. At this time, the movable iron pieces 14 are supported by the case 2 or an unshown cover, via the support shaft 18*a*, so as to be pivotable in a direction in which the two movable iron pieces 15 and 16 are aligned, that is, in a left-right direction on the planes of FIGS. 1 and 2.

The electrical contact portion 20 includes a fixed contact portion 20A, wherein a fixed contact 22 is joined to a fixed terminal plate 21, and a movable contact portion 20B wherein a movable contact spring 25 to which is joined a movable contact 24 is joined to a movable terminal plate 23. The fixed contact portion 20A and movable contact portion 20B are housed in the case 2 so as to be facing each other, and the fixed contact 22 and movable contact 24 are spaced apart from and disposed facing each other so as to be capable of contacting with and separating from each other.

In order to link the electromagnet portion 10 and electrical contact portion 20, a sliding plate 31 supported by the case 2 so as to be horizontally slidable is provided, as shown in FIG. 1. The electromagnet portion 10 and electrical contact portion 20 are linked by engaging one end of the sliding plate 31 with the engagement piece 16*a* of the movable iron piece 14 and engaging the other end with the leading end of the movable contact spring 25 of the electrical contact portion 20.

Next, a description will be given, referring to FIGS. 6(A), 6(B), of a switching operation of the electrical contact portion of the latching relay configured in this way.

Figure 6A:
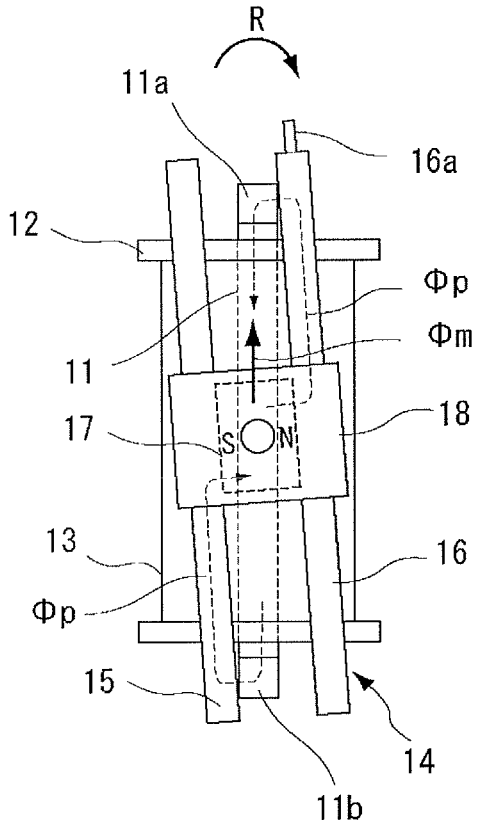
FIGS. 6(A), 6(B) show illustrations of a switching operation of the latching relay of the first embodiment of the invention.
Figure 6B:
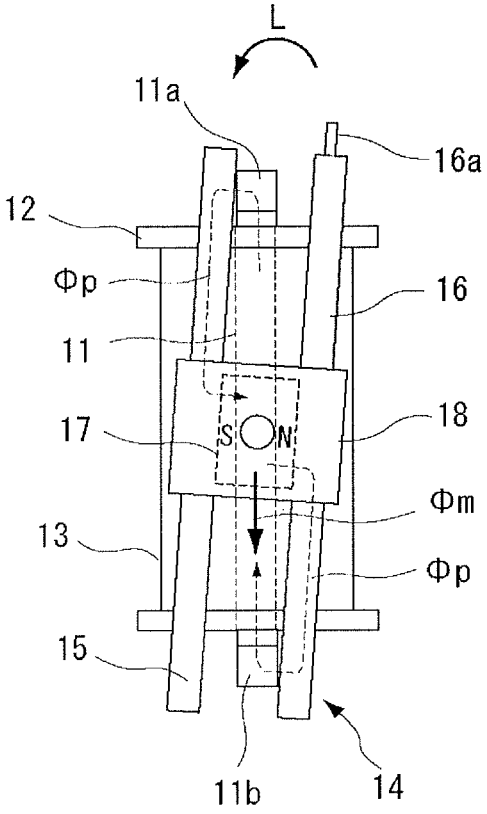

The permanent magnet 17 incorporated in the movable iron pieces 14 is disposed so that the side in contact with the bar-shaped iron piece 16 is the N pole and the side in contact with the bar-shaped iron piece 15 is the S pole, as shown in FIGS. 6(A), 6(B).

When in a condition in which the movable iron pieces 14 are pivoted in a counterclockwise direction by an upper end portion of the bar-shaped iron piece 16 being attracted to the upper end side magnetic pole piece 11*a* of the fixed iron core 11, and a lower end portion of the bar-shaped iron piece 15 being attracted to the lower end side magnetic pole piece 11*b*, by the magnetic force of the permanent magnet 17, as shown in FIG. 6(A), the sliding plate 31 engaged with the leading end of the bar-shaped iron piece 16 is pulled to the left side by the movable iron pieces 14, meaning that the sliding plate 31 is in a position in which it is moved horizontally to the left side (the electromagnet portion side), as shown in FIG. 1. By so doing, the leading end of the movable contact spring 25 of the electrical contact portion 20 is pulled to the left side by the sliding plate 31, meaning that the movable contact 24 separates from the fixed contact 22, and the electrical contact portion 20 switches to an off state.

In this condition, when a DC exciting current of a polarity which generates an upward magnetic flux ϕm is passed through the exciting coil 13, as shown by the solid arrow in FIG. 6(A), the magnetic flux ϕm takes on a polarity the reverse of that of a magnetic flux ϕp, shown by the dashed arrows, generated by the permanent magnet 17, meaning that a magnetic repulsion force is generated between the magnetic pole piece 11*a* of the upper end of the fixed iron core 11 and the upper end of the bar-shaped iron piece 16 of the movable iron pieces 14, which are in contact with each other, and between the magnetic pole piece 11*b* of the lower end of the fixed iron core 11 and the lower end of the bar-shaped iron piece 15 of the movable iron pieces 14, which are in contact with each other. Further, a magnetic attraction force is generated between the magnetic pole piece 11*a* of the upper end of the fixed iron core and the upper end of the bar-shaped iron piece 15 of the movable iron pieces 14, which are separated from each other, and between the magnetic pole piece 11*b* of the lower end of the fixed iron core 11 and the lower end of the bar-shaped iron piece 16 of the movable iron pieces 14, which are separated from each other. By so doing, the movable iron pieces 14 pivot in an arrow R direction (a clockwise direction) shown in FIG. 6(A), and switch to a condition in which the bar-shaped iron piece 15 upper end and bar-shaped iron piece 16 lower end of the movable iron pieces 14 are attracted to the magnetic pole piece 11*a* of the upper end of the fixed iron core 11 and the magnetic pole piece 11*b* of the lower end thereof respectively as shown in FIG. 6(B).

By the pivotal position of the movable iron pieces 14 switching in this way, the sliding plate 31 moves by being pushed in a right direction by the movable iron pieces 14. By so doing, the leading end of the movable contact spring 25 of the electrical contact portion 20 moves in the right direction, as shown by the dashed line in FIG. 1, meaning that the movable contact 24 abuts against the fixed contact 22, and the electrical contact portion 20 switches to an on state. The passage of exciting current through the exciting coil 13 is stopped after the state of the electrical contact portion 20 has switched, but after the passage of exciting current has been stopped, the magnetic flux ϕp generated by the permanent magnet 17 passes between the movable iron pieces 14 and fixed iron core 11 in a direction opposite the direction shown in FIG. 6(A), as shown by the dashed arrows in FIG. 6(B), and a magnetic attraction force is generated both between the upper end of the bar-shaped iron piece 15 of the movable iron pieces and the magnetic pole piece 11*a* of the upper end of the fixed iron core 11, which are in contact with each other, and between the lower end of the bar-shaped iron piece 16 and the magnetic pole piece 11*b* of the lower end, which are in contact with each other, and this pivotal position is maintained, meaning that it is possible for the electrical contact portion 20 to retain the on state unchanged.

In the condition shown in FIG. 6(B), when an exciting current of a polarity the reverse of the previous one is passed through the exciting coil 13, a downward magnetic flux ϕm is generated in the fixed iron core 11, as shown by the solid arrow, and this time, a magnetic repulsion force is generated between the magnetic pole piece 11*a* of the upper end of the fixed iron core 11 and the upper end of the bar-shaped iron piece 15 of the movable iron pieces 14, which are in contact with each other, and between the magnetic pole piece 11*b* of the lower end of the fixed iron core 11 and the lower end of the bar-shaped iron piece 16 of the movable iron pieces 14, which are in contact with each other. Further, a magnetic attraction force is generated between the magnetic pole piece 11*a* of the upper end of the fixed iron core 11 and the upper end of the bar-shaped iron piece 16 of the movable iron pieces 14, which are separated from each other, and between the magnetic pole piece 11*b* of the lower end of the fixed iron core 11 and the lower end of the bar-shaped iron piece 15 of the movable iron pieces 14, which are separated from each other. By so doing, the movable iron pieces 14 pivot in an arrow L direction (a counterclockwise direction) shown in FIG. 6(B), and the bar-shaped iron piece 16 upper end and bar-shaped iron piece 15 lower end of the movable iron pieces 14 are attracted to the magnetic pole piece 11*a* of the upper end of the fixed iron core and the magnetic pole piece 11*b* of the lower end thereof respectively, meaning that the movable iron pieces 14 switch to the condition shown in FIG. 6(A).

By the pivotal position of the movable iron pieces 14 switching in this way, the sliding plate 31 moves by being pulled in a left direction by the movable iron pieces 14. By so doing, the leading end of the movable contact spring 25 of the electrical contact portion 20 moves in the left direction, and returns to the original position shown by the solid line in FIG. 1, meaning that the movable contact 24 separates from the fixed contact 22, and the electrical contact portion 20 switches to the off state. The passage of exciting current through the exciting coil 13 is stopped after the state of the electrical contact portion 20 has switched, but after the passage of exciting current has been stopped, the magnetic flux ϕp of the permanent magnet 17 passes between the movable iron pieces 14 and fixed iron core 11 in a direction opposite the direction of the passage of exciting current in FIG. 6(B), as shown by the dashed arrows in FIG. 6(A), and this pivotal position is maintained by a magnetic attraction force generated both between the upper end of the bar-shaped iron piece 16 of the movable iron pieces 14 and the magnetic pole piece 11*a* of the upper end of the fixed iron core 11, which are in contact with each other, and between the lower end of the bar-shaped iron piece 15 and the magnetic pole piece 11*b* of the lower end, which are in contact with each other, meaning that it is possible for the electrical contact portion 20 to retain the off state unchanged.

Second Embodiment

Figure 7:
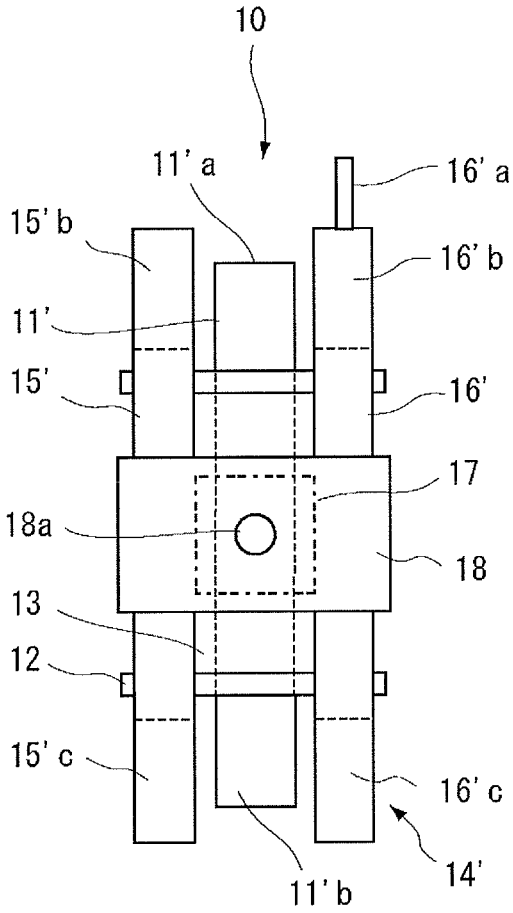
FIG. 7 is a front view of an electromagnet portion used in a latching relay of a second embodiment of the invention.
Figure 8:
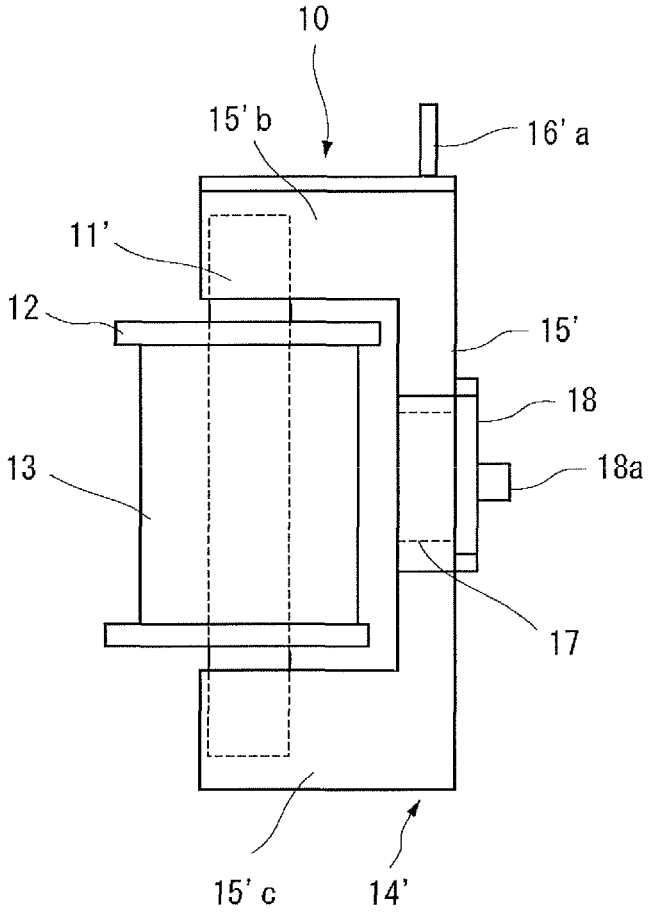
FIG. 8 is a side view of the electromagnet portion used in the latching relay of the second embodiment of the invention.
Figure 9:
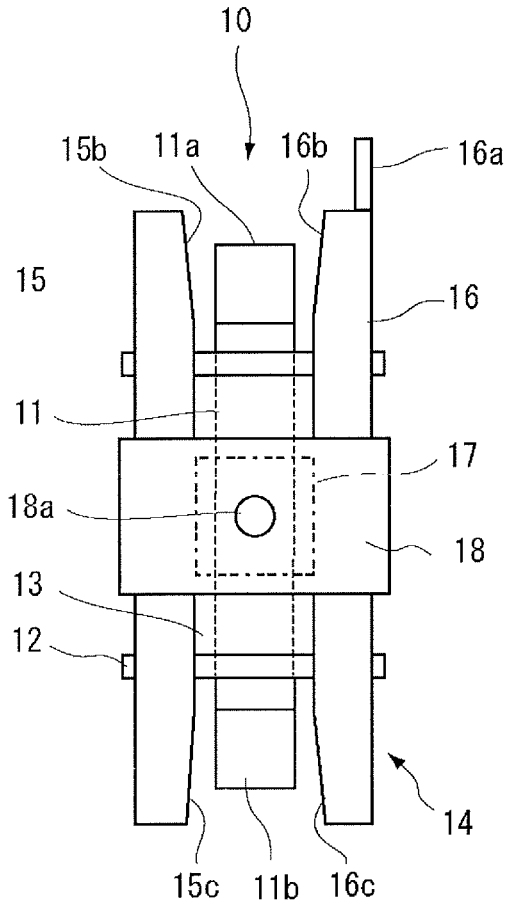
FIG. 9 is a front view of an electromagnet portion used in a latching relay of a third embodiment of the invention.
Figure 10:
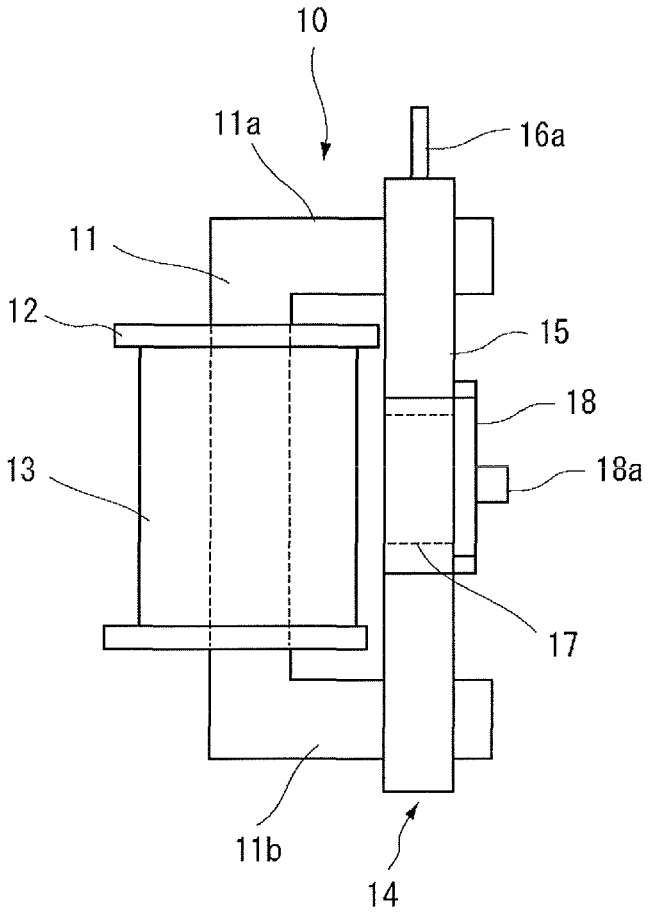
FIG. 10 is a side view of the electromagnet portion used in the latching relay of the third embodiment of the invention.

FIGS. 7 and 8 show a configuration of an electromagnet portion according to the second embodiment of the invention.

In the previously described first embodiment, the fixed iron core 11 of the electromagnet portion 10 is configured of an iron core formed in a substantially U shape, and the movable iron pieces 14 facing the fixed iron core 11 are configured of the two I-shaped bar-shaped iron pieces 15 and 16, but in the second embodiment, a fixed iron core 11' of the electromagnet portion 10 is configured of an I-shaped bar-shaped iron core, and movable iron pieces 14' facing the fixed iron core 11' are configured of two movable iron pieces 15' and 16' formed in a substantially U shape. The two movable iron pieces 15' and 16' sandwich the permanent magnet 17 in an intermediate portion and are integrally held by the holder 18 made from an insulating resin. An engagement piece 16'*a* for a linkage with the electrical contact portion 20 is formed at the leading end of one movable iron piece 16', and the support shaft 18*a* for pivotally supporting the movable iron pieces 14' is provided on the outer side of the central portion of the holder 18.

The movable iron pieces 14' configured in this way are housed in the case 2 in the same way as in the first embodiment of FIG. 1, disposed facing the fixed iron core 11' so that both end portions forming the magnetic pole pieces of the fixed iron core 11' are inserted in a space between leg piece portions 15'*b* and 16'*b* of the two movable iron pieces 15' and 16' and between leg piece portions 15'*c* and 16'*c*, as shown in FIGS. 7 and 8. At this time, the movable iron pieces 14' are supported by the case 2 or an unshown cover, via the support shaft 18*a*, so as to be pivotable in a direction in which the two movable iron pieces 15' and 16' are aligned, that is, in a left-right direction on the plane of FIG. 7.

The other configurations of the second embodiment are the same as those of the first embodiment, and in exactly the same way as in the first embodiment, by switching the polarity of an exciting current passed through the exciting coil 13 of the electromagnet portion 10, it is possible to switch the pivotal position of the movable iron pieces 14' between a forward pivotal position and a reverse pivotal position, and it is thus possible to switch the electrical contact portion 20 between the on and off states, and to retain a switched state with the magnetic force of the permanent magnet even after the passage of exciting current is stopped.

Third Embodiment

FIGS. 9 to 12 show a configuration of an electromagnet portion according to the third embodiment of the invention.

The third embodiment is such that the previously described the first embodiment is improved in such a way as to increase the pivotal stroke (pivotal angle) of the movable iron pieces 14 of the electromagnet portion 10 and the magnetic attraction retaining force between the fixed iron core and movable iron pieces of the electromagnet portion 10.

The electromagnet portion 10 in third embodiment, in the same way as the electromagnet portion 10 in first embodiment, is such that the fixed iron core 11 is configured of a substantially U-shaped iron core, and the movable iron pieces 14 facing the fixed iron core 11 are configured of two I-shaped bar-shaped iron pieces 15 and 16. Further, the two movable iron pieces 15 and 16 sandwich the permanent magnet 17 in an intermediate portion, and are integrally held by the holder 18 made from an insulating resin. The engagement piece 16*a* for a linkage with the electrical contact portion 20 is formed at the leading end of one movable iron piece 16, and the support shaft 18*a* for pivotally supporting the movable iron pieces 14 is provided on the outer side of the central portion of the holder 18 (refer to FIGS. 9 and 10).

In the third embodiment, furthermore, slant surfaces 15*b* and 15*c* and 16*b* and 16*c* formed in portions contacting with the fixed iron core 11 by the movable iron pieces 14 being partially cut away at a slant are provided on surfaces, facing the fixed iron core 11, of upper and lower end portions of the two I-shaped bar-shaped iron pieces 15 and 16 of the movable iron pieces 14, and the third embodiment differs in this point from the first embodiment.

With the electromagnet portion 10 of the third embodiment configured in this way, in exactly the same as with the first embodiment, by switching the polarity of an exciting current passed through the exciting coil 13 of the electromagnet portion 10, it is possible to switch the pivotal position of the movable iron pieces 14 between the forward pivotal position and reverse pivotal position, thus switching the electrical contact portion between the on and off states, and it is possible to retain the pivotal position unchanged with the magnetic force of the permanent magnet even after the passage of exciting current is stopped.

Figure 11A:
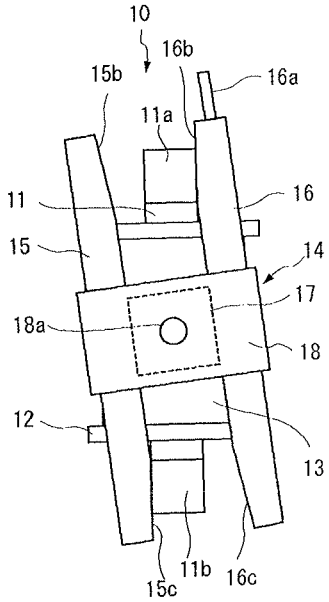
FIGS. 11(A), 11(B) show front views of switched conditions of the electromagnet portion used in the latching relay of the third embodiment of the invention.
Figure 11B:
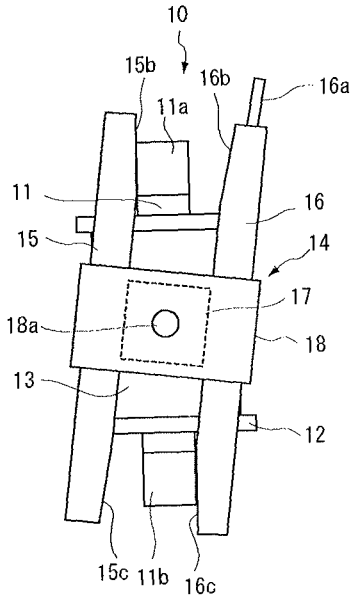

As the slant surfaces 15*b* and 15*c* and 16*b* and 16*c* are provided in the portions, contacting with the fixed iron core 11, of the respective surfaces, facing the fixed iron core 11, of the upper and lower end portions of the two I-shaped bar-shaped iron pieces 15 and 16 of the movable iron pieces 14 of the electromagnet portion 10 of the third embodiment, the movable iron pieces 14 pivot in the left direction or right direction, and each contacts with the fixed iron core 11, and in a retained pivotal position, substantially the whole area of each of the slant surfaces 15*c* and 16*b* and slant surfaces 15*b* and 16*c* contact with a corresponding opposite side surface of the fixed iron core 11, thus bringing the movable iron pieces 14 and fixed iron core 11 into surface contact with each other, as shown in FIGS. 11(A), 11(B).

By the slant surfaces being provided in the portions, contacting with the fixed iron core 11, of the upper and lower end portions of the movable iron piece 14 in this way, the area of contact between the movable iron pieces 14 and fixed iron core 11 increases by the two surface contacting with each other in a pivotal position retained by the movable iron pieces 14 pivoting to the left or right and contacting with the fixed iron core 11, meaning that the force of retaining the movable iron pieces 14 with the magnetic force of the fixed iron core 11 increases, and the resistance to a vibration, impact force, or the like, from the exterior is enhanced, thus enabling an improvement in stability of the operation of the electrical contact portion.

Figure 12:
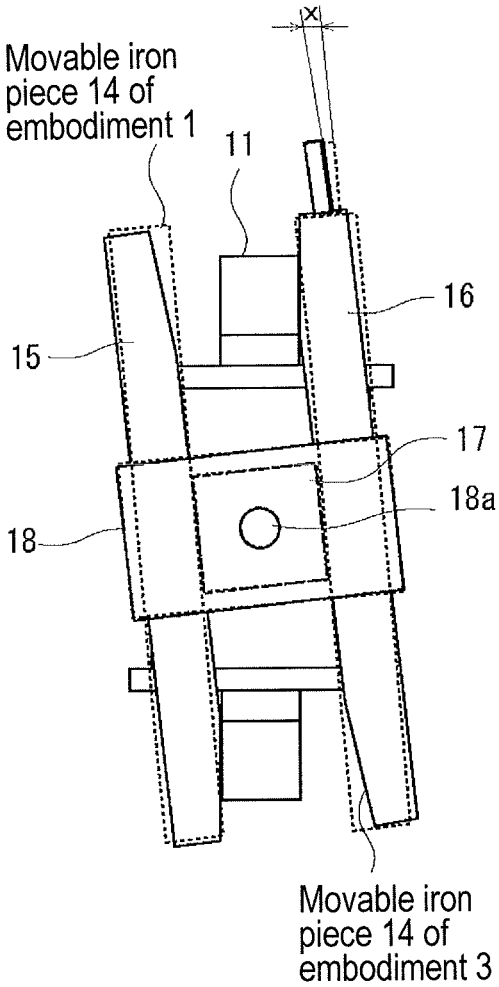
FIG. 12 is a diagram illustrating a function of the electromagnet portion used in the latching relay of the third embodiment of the invention.

Also, according to the third embodiment, the pivotal angle of the movable iron pieces 14 increases by an amount equivalent to an amount in which the movable iron pieces 14 are cut away in order to provide the slant surfaces. As a result of this, as the movable iron pieces 14 of the first embodiment shown by the dotted lines, and the movable iron pieces 14 of the third embodiment shown by the solid lines, in FIG. 12 are shown superimposed on each other, the pivotal stroke (pivotal angle) of the movable iron pieces 14 of the third embodiment increases by a displacement difference x between the two. Because of this, with the latching relay using the electromagnet portion of the third embodiment, the contact opening distance of the electrical contact portion increases, and it is possible to enhance the voltage proof of the latching relay.

Fourth Embodiment

Figure 13:
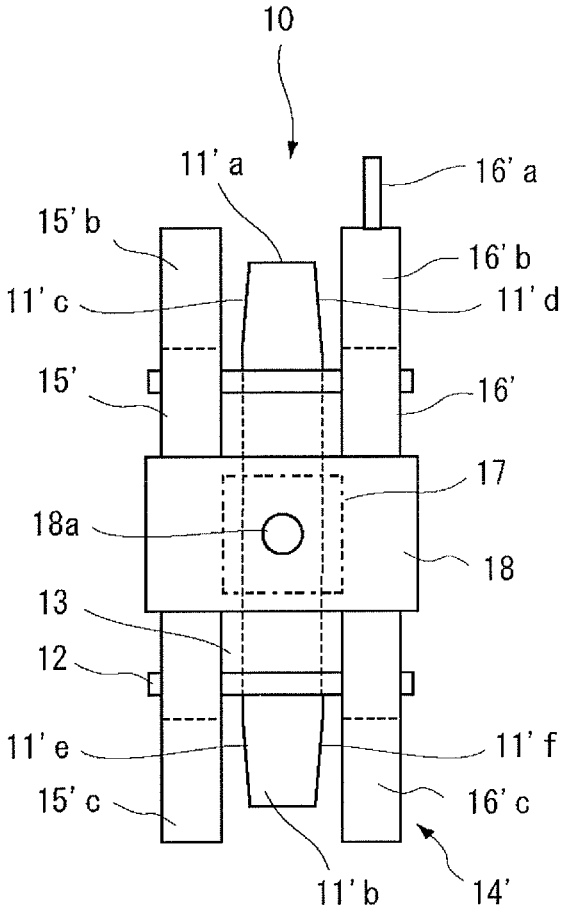
FIG. 13 is a front view of an electromagnet portion used in a latching relay of a fourth embodiment of the invention.
Figure 14:
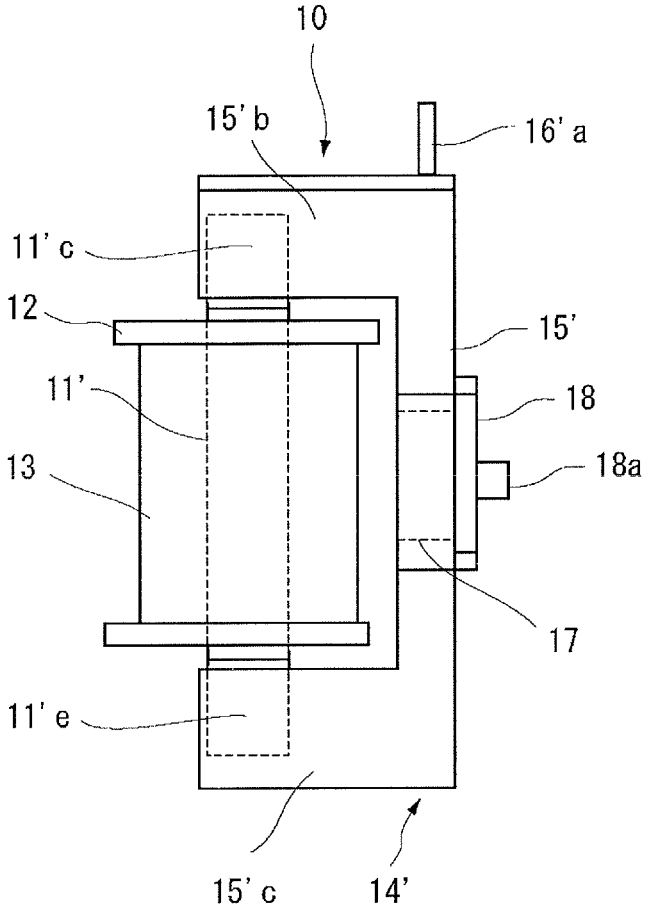
FIG. 14 is a side view of the electromagnet portion used in the latching relay of the fourth embodiment of the invention.

FIGS. 13 to 15 show a configuration of an electromagnet portion according to the fourth embodiment of the invention.

The fourth embodiment is such that the previously described second embodiment is improved in such a way as to increase the pivotal stroke (pivotal angle) of the movable iron pieces 14' of the electromagnet portion 10 and the magnetic attraction retaining force between the fixed iron core and movable iron pieces of the electromagnet portion 10.

The electromagnet portion 10 of fourth embodiment, in the same way as the electromagnet portion 10 of second embodiment, includes the fixed iron core 11' configured of an I-shaped bar-shaped iron core and the movable iron pieces 14' configured of the two movable iron pieces 15' and 16' formed in a substantially U shape. The two movable iron pieces 15' and 16' sandwich the permanent magnet 17 in an intermediate portion, and are integrally held by the holder 18 made from an insulating resin. The engagement piece 16'*a* for a linkage with the electrical contact portion 20 is formed at the leading end of one movable iron piece 16', and the support shaft 18*a* for pivotally supporting the movable iron pieces 14' is provided on the outer side of the central portion of the holder 18.

In the fourth embodiment, furthermore, slant surfaces 11'*c* and 11'*d* and 11'*e* and 11T formed by portions contacting with the movable iron pieces 15' and 16' being cut away at a slant are provided on respective side surfaces, facing the movable iron pieces 14', of upper and lower end portions of the fixed iron core 11' configured of the I-shaped bar-shaped iron core, and the fourth embodiment differs in this point from the second embodiment.

Figure 15A:
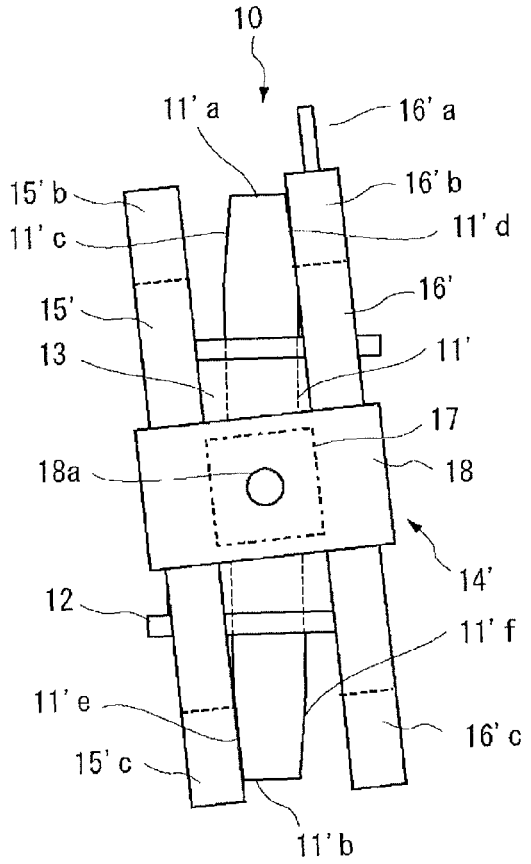
FIGS. 15(A), 15(B) show front views of switched conditions of the electromagnet portion used in the latching relay of the fourth embodiment of the invention.
Figure 15B:
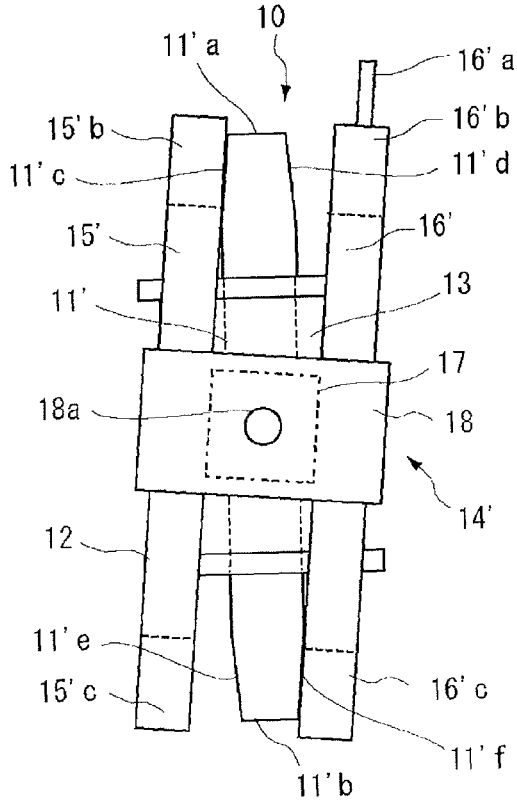

With the electromagnet portion 10 of the fourth embodiment configured in this way, in exactly the same as with the second embodiment, by switching the polarity of an exciting current passed through the exciting coil 13 of the electromagnet portion 10, it is possible to switch the pivotal position of the movable iron pieces 14' between the forward pivotal position and reverse pivotal position, thus switching the electrical contact portion between the on and off states, and it is possible to retain the pivotal position unchanged with the magnetic force of the permanent magnet, as shown in FIGS. 15(A) and 15(B), even after the passage of exciting current is stopped.

As the slant surfaces 11'*c* and 11'*d* and 11'*e* and 11'*f* are provided in the respective portions, contacting with the movable iron pieces, of the surfaces, facing the movable iron pieces 14', of the upper and lower end portions of the I-shaped fixed iron core 11' in the electromagnet portion 10 of the fourth embodiment, the opposite side surfaces of the movable iron pieces 14' contact one with substantially the whole area of each of the slant surfaces 11'*d* and 11'*e* and slant surfaces 11'*c* and 11'*f*, as shown in FIGS. 15(A) and 15(B), in a pivotal position retained by the movable iron pieces 14' pivoting in the left direction or right direction and contacting with the fixed iron core 11', thus bringing the fixed iron core 11' and movable iron pieces 14' into surface contact with each other.

According to this kind of fourth embodiment, in the same way as in the third embodiment, by the slant surfaces being provided in the portions, contacting with the movable iron pieces 14', of the upper and lower end portions of the fixed iron core 11', the area of contact between the movable iron pieces 14' and fixed iron core 11' increases by the two surfaces contacting with each other in the pivotal position retained by the movable iron pieces 14' pivoting in the left or right direction and contacting with the fixed iron core 11', meaning that the force of retaining the movable iron pieces 14' with the magnetic force of the fixed iron core 11' increases, and the resistance to a vibration, impact force, or the like, from the exterior is enhanced, thus enabling an improvement in stability of the operation of the electrical contact portion.

Also, according to the fourth embodiment, the pivotal angle of the movable iron pieces 14' increases by an amount equivalent to an amount in which the fixed iron core 11' is partially cut away at a slant in order to provide the slant surfaces. As a result of this, in the same way as in the third embodiment, the pivotal stroke (pivotal angle) of the movable iron pieces 14' increases, meaning that the latching relay using the electromagnet portion of the fourth embodiment is such that the contact opening distance of the electrical contact portion increases, and it is possible to enhance the voltage proof of the latching relay.

Fifth Embodiment

The fifth embodiment of the latching relay of the invention is shown in FIGS. 16 to 18(B).

Figure 16:
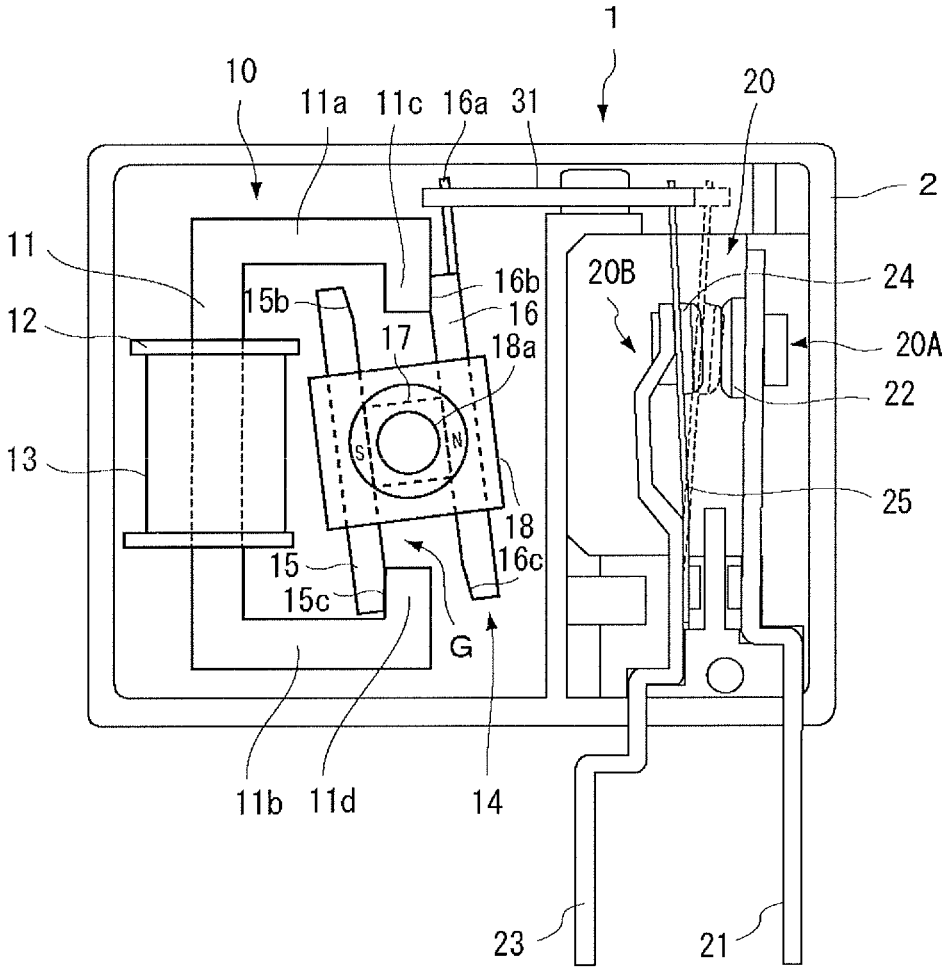
FIG. 16, showing a fifth embodiment of the invention, is a front view of a latching relay with a cover removed therefrom.

The latching relay 1 of the fifth embodiment is configured by housing the electromagnet portion 10 and electrical contact portion 20 in the case 2 made from an insulating resin, as shown in FIG. 16, and has substantially the same configuration as that of the first embodiment shown in FIG. 1.

However, the fifth embodiment differs from the first embodiment in the following configurations.

Firstly, the first point is a configuration wherein the orientation of the fixed iron core 11 on which is mounted the exciting coil 13 of the electromagnet portion 10 is an orientation in which the fixed iron core 11 of the first embodiment (FIG. 1) is rotated 90° in a horizontal direction.

Further, the second point is a configuration wherein magnetic pole pieces 11*c* and 11*d* extending shortly in an up-down direction are newly formed by inwardly bending each of the leading ends of the upper and lower horizontal magnetic pole pieces 11*a* and 11*b* of the fixed iron core 11 at a right angle, thus forming the fixed iron core 11 in a substantially C shape.

Figure 17A:
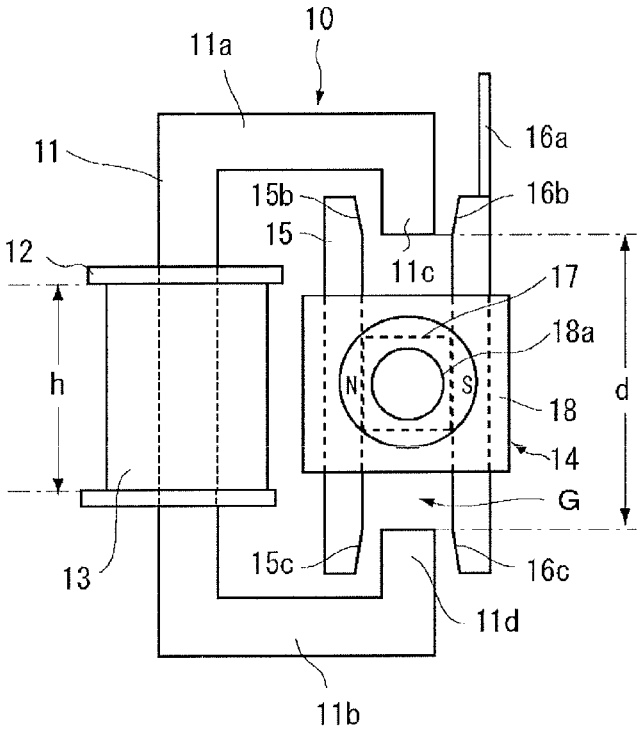
Figure 17B:
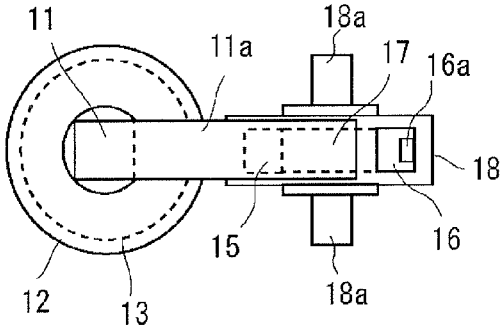
Figure 17C:
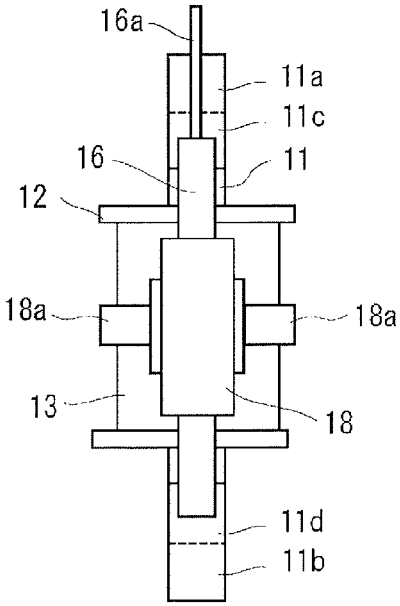

The electromagnet portion 10, as the details are shown in FIGS. 17(*a*)-17(*c*), has the fixed iron core 11 formed in a substantially C shape including at the leading ends the magnetic pole pieces 11*c* and 11*d* extending shortly in the up-down direction. The coil bobbin 12 around which is wound the exciting coil 13 is mounted on an intermediate portion of the fixed iron core 11. An arrangement is such that a winding height h of the exciting coil 13 wound around the coil bobbin 12 is maintained to a size equal to or less than a gap width d between the magnetic pole pieces 11*c* and 11*d* of the fixed iron core 11 in order to facilitate a winding work.

Further, the movable iron pieces 14 are pivotally disposed in a space G cut open between the opposed magnetic pole pieces 11*c* and 11*d* of the fixed iron core 11. The movable iron pieces 14, in the same way as the movable iron pieces in the first embodiment, is configured by the two I-shaped bar-shaped iron pieces 15 and 16 spaced apart from and disposed in parallel with each other and the rectangular parallelepiped permanent magnet 17 sandwiched in the central portion between the iron pieces 15 and 16 being integrally held and fixed by the holder 18 configured from an insulating resin. The engagement piece 16*a* engaged with the sliding plate 31 for a linkage with the electrical contact portion 20 is joined integrally to the upper end of one bar-shaped iron piece 16.

Pivotal support shafts 18*a* for pivotally supporting the movable iron pieces 14 are provided on the holder 18. The support shafts 18*a*, when housed in the case 2, are supported by bearings, not shown here, formed in the case 2, and support the movable iron pieces 14 so that the movable iron pieces 14 are pivotable in a direction in which the bar-shaped iron pieces 15 and 16 are aligned.

An arrangement is such that the movable iron pieces 14 and fixed iron core 11 are disposed facing each other so that the leading end portions of the upper and lower magnetic pole pieces 11*c* and 11*d* of the fixed iron core 11 is inserted into the space between the two bar-shaped iron pieces 14 and 16 when the movable iron pieces 14 are disposed inserted into the space G cut open between the opposed magnetic pole pieces 11*c* and 11*d* of the fixed iron core 11.

Also, slant surfaces 15*b* and 15*c* and 16*b* and 16*c* are formed on respective surfaces, facing the magnetic pole pieces 11*c* and 11*d*, of the upper and lower end portions of the bar-shaped iron pieces 15 and 16.

The switching operation of the latching relay of the fifth embodiment configured in this way is basically the same as the switching operation of the latching relay of the first embodiment.

Figure 18A:
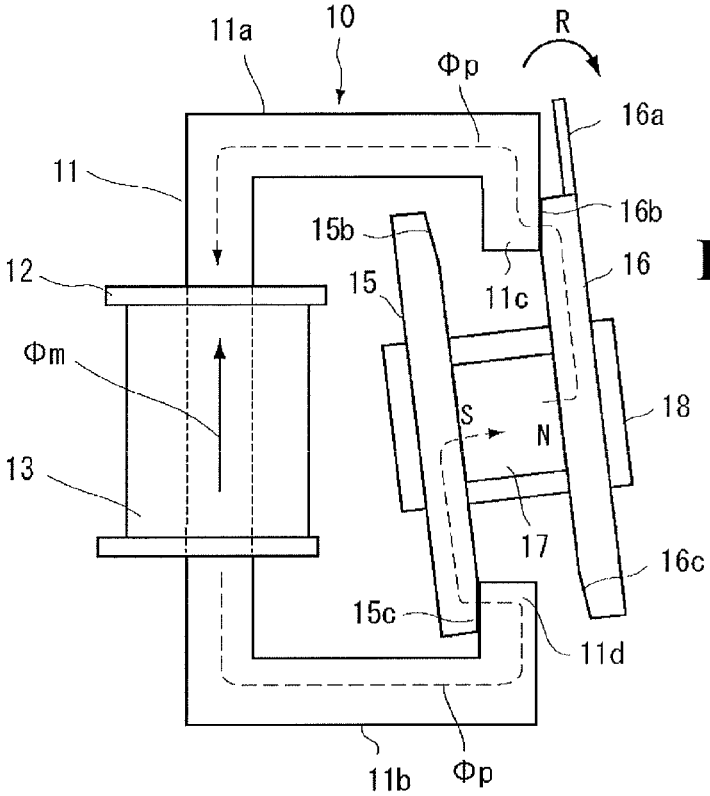
FIGS. 18(A), 18(B) show illustrations of a switching operation of the latching relay of the fifth embodiment of the invention.

That is, when the slant surface 16*b* of the upper end portion of the bar-shaped iron piece 16 of the movable iron pieces 14 is attracted to the upper end side magnetic pole piece 11*c* of the fixed iron core 11, and the slant surface 15*c* of the lower end portion of the bar-shaped iron piece 15 is attracted to the lower end side magnetic pole piece 11*d*, by a magnetic force of the permanent magnet 17 magnetized with the polarity shown in FIG. 18(A), and when in a condition in which the movable iron pieces 14 are pivoted in the counterclockwise direction, as shown in FIG. 18(A), the sliding plate 31 is in a position in which it is pulled to the left side by the engagement piece 16*a* of the movable iron pieces 14 joined to the bar-shaped conductor 16, as shown in FIG. 16. Because of this, the leading end of the movable contact spring 25 of the electrical contact portion 20 is pulled to the left side by the sliding plate 31, meaning that the movable contact 24 separates from the fixed contact 22, and the electrical contact portion 20 switches to the off state.

In this condition, when a DC exciting current of a polarity which generates an upward magnetic flux ϕm, as shown by the solid arrow in FIG. 18(A), is passed through the exciting coil 13, the magnetic flux ϕm takes on a polarity the reverse of that of a magnetic flux ϕp, shown by the dashed arrows, generated by the permanent magnet 17, meaning that a magnetic repulsion force is generated between the upper side magnetic pole piece 11*c* of the fixed iron core 11 and the slant surface 16*b* of the upper end portion of the bar-shaped iron piece 16 of the movable iron pieces 14, which are in contact with each other, and between the lower side magnetic pole piece 11*d* of the fixed iron core 11 and the slant surface 15*c* of the lower end portion of the bar-shaped iron piece 15 of the movable iron pieces 14, which are in contact with each other. Further, a magnetic attraction force is generated between the upper side magnetic pole piece 11*c* of the fixed iron core 11 and the slant surface 15*b* of the upper end portion of the bar-shaped iron piece 15 of the movable iron pieces 14, which are separated from each other, and between the lower side magnetic pole piece 11*d* of the fixed iron core 11 and the slant surface 16*c* of the lower end portion of the bar-shaped iron piece 16 of the movable iron pieces 14, which are separated from each other. Because of this, the movable iron pieces 14 pivot in an arrow R direction (a clockwise direction) shown in FIG. 18(A), and the slant surface 15*b* of the upper end portion of the bar-shaped iron piece 15 of the movable iron pieces 14 and the slant surface 16*c* of the lower end portion of the bar-shaped iron piece 16 switch to a condition in which the slant surface 15*b* and slant surface 16*c* are attracted to the upper side magnetic pole piece 11*c* and lower side magnetic pole piece 11*d* of the fixed iron core 11 respectively, as shown in FIG. 18(B).

By the pivotal position of the movable iron pieces 14 switching in this way, the sliding plate 31 moves by being pushed in a right direction by the movable iron pieces 14 via the engagement piece 16*a*. By so doing, the leading end of the movable contact spring 25 of the electrical contact portion 20 moves in the right direction, as shown by the dashed line in FIG. 16, meaning that the movable contact 24 abuts against the fixed contact 22, and the electrical contact portion 20 switches to the on state. The passage of exciting current through the exciting coil 13 is stopped after the state of the electrical contact portion 20 has switched, but after the passage of exciting current has been stopped, the magnetic flux ϕp generated by the permanent magnet 17 passes between the movable iron pieces 14 and fixed iron core 11, as shown by the dashed arrows in FIG. 18(B). The slant surface 14*b* of the upper end portion of the bar-shaped iron piece 15 of the movable iron pieces 14 is magnetically attracted to the upper side magnetic pole piece 11*c* of the fixed iron core 11, and the slant surface 16*c* of the lower end portion of the bar-shaped iron piece 16 is magnetically attracted to the lower end side magnetic pole-piece 11*d*, by a magnetic force generated by the magnetic flux ϕp, and this pivotal position is maintained, meaning that it is possible to retain the electrical contact portion 20 unchanged in the on state.

Figure 18B:
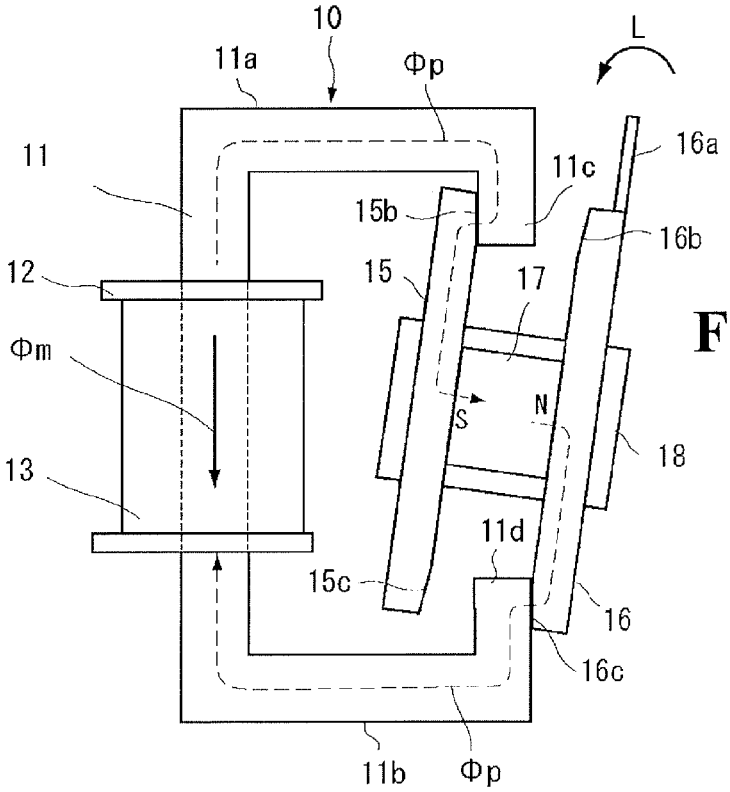
Figure 19:
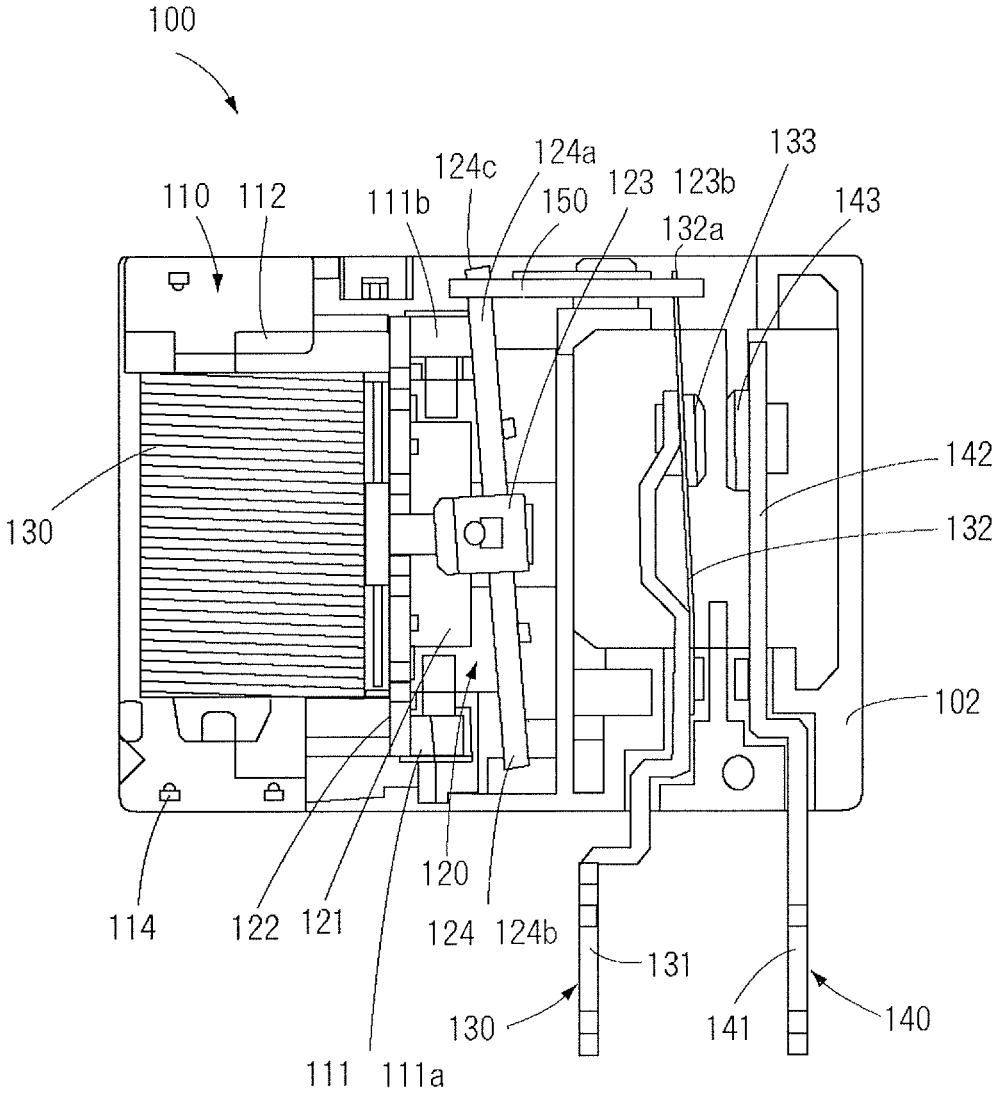
Fig. 19 Prior Art
FIG. 19 is a front view of a heretofore known latching relay with a cover removed therefrom.
Figure 20A:
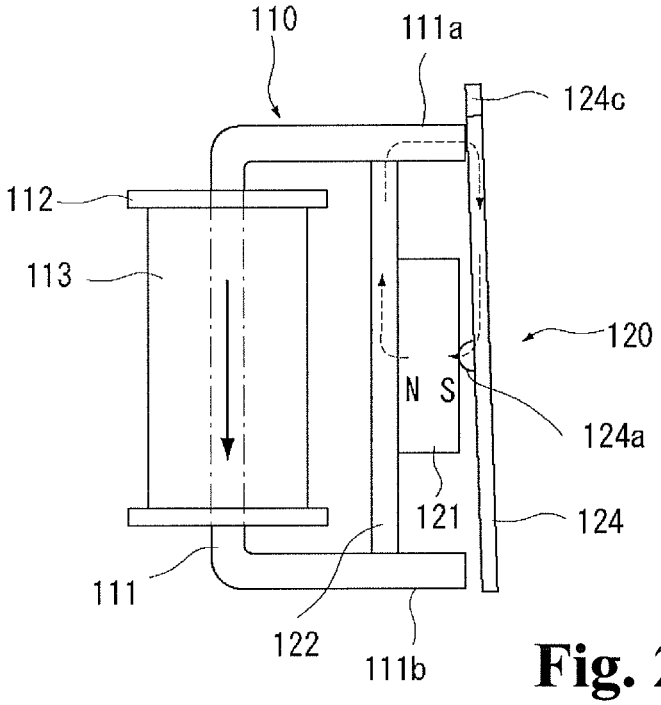
Fig. 20(A) Prior Art
FIGS. 20(A), 20(B) show illustrations of a switching operation of the heretofore known latching relay.
Figure 20B:
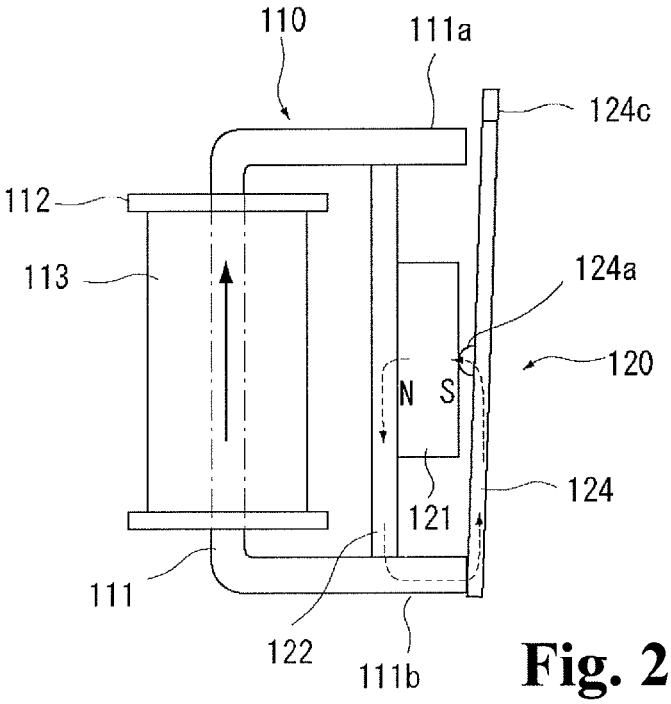
Fig. 20(B) Prior Art

When an exciting current of a polarity the reverse of the previous one is passed through the exciting coil 13 in the condition shown in FIG. 18(B), a downward magnetic flux ϕm is generated in the fixed iron core 11, as shown by the solid arrow, and this time, a magnetic repulsion force is generated between the upper side magnetic pole piece 11*c* of the fixed iron core 11 and the slant surface 15*b* of the upper end portion of the bar-shaped iron piece 15 of the movable iron pieces 14, which are in contact with each other, and between the lower side magnetic pole piece 11*d* of the fixed iron core 11 and the slant surface 16*c* of the lower end portion of the bar-shaped iron piece 16 of the movable iron pieces 14, which are in contact with each other. Further, a magnetic attraction force is generated between the upper side magnetic pole piece 11*c* of the fixed iron core 11 and the slant surface 16*b* of the upper end portion of the bar-shaped iron piece 16 of the movable iron pieces 14, which are separate from each other, and between the lower side magnetic pole piece 11*d* of the fixed iron core 11 and the slant surface 15*c* of the lower end portion of the bar-shaped iron piece 15 of the movable iron pieces 14, which are separate from each other. Because of this, the movable iron pieces 14 pivot in an arrow L direction (the counterclockwise direction) shown in FIG. 18(B), and the slant surface 16*b* of the upper end portion of the bar-shaped iron piece 16 of the movable iron pieces 14 and the slant surface 15*c* of the lower end portion of the bar-shaped iron piece 15 are attracted to the magnetic pole piece 11*c* of the upper end of the fixed iron core 11 and the magnetic pole piece 11*d* of the lower end thereof respectively, meaning that the movable iron pieces 14 switch to the condition shown in FIG. 18(A).

By the pivotal position of the movable iron pieces 14 switching in this way, the sliding plate 31 moves to the left side by being pulled by the movable iron pieces 14. By so doing, the leading end of the movable contact spring 25 of the electrical contact portion 20 moves in the left direction, and returns to the original position shown by the solid line in FIG. 16, meaning that the movable contact 24 separates from the fixed contact 22, and the electrical contact portion 20 switches to the off state. The passage of exciting current through the exciting coil 13 is stopped after the state of the electrical contact portion 20 has switched, but after the passage of exciting current is stopped, the magnetic flux ϕp of the permanent magnet 17 passes between the movable iron pieces 14 and fixed iron core 11, as shown by the dashed arrows in FIG. 18(A). The slant surface 16*b* of the upper end portion of the bar-shaped iron piece 16 of the movable iron pieces 14 and the upper side magnetic pole piece 11*c* of the fixed iron core 11, which are in contact with each other, are magnetically attracted, and the slant surface 15*c* of the lower end portion of the bar-shaped iron piece 15 and the lower side magnetic pole piece 11*d*, which are in contact with each other, are magnetically attracted, by the magnetic force of the magnetic flux ϕp, and this position is maintained, meaning that it is possible to retain the electrical contact portion 20 unchanged in the off state.

When an arrangement is adopted such that the fixed iron core 11 of the electromagnet portion 10 is configured of an iron core formed in a substantially C shape, and the movable iron pieces 14 are disposed in the space G of the portion cut open of the C-shaped fixed iron core 11 as in the fifth embodiment, one bar-shaped iron piece 15 of the movable iron pieces 14 is disposed in the space of the C-shaped fixed iron core, meaning that it is possible to reduce the whole of the electromagnet portion 10 to a small size. Further, as a configuration is such that the exciting coil 13 and movable iron pieces 14 of the electromagnet portion 10 and the electrical contact portion 20 are linearly disposed, it is possible to keep the thickness of the latching relay within the size of the diameter of the exciting coil 13, thus enabling a thinner configuration of the latching relay.

In the invention, it is also possible to provide slant surfaces one on each of the mutually facing surfaces of the fixed iron core and movable iron pieces of the electromagnet portion, and when an arrangement is adopted such that slant surfaces are provided on both the fixed iron core and movable iron pieces, it is possible to further increase the pivotal stroke (pivotal angle) of the movable iron pieces.

In this way, in the invention, it is possible to switch the electrical contact portion between the on and off states by switching the polarity which causes an exciting current to pass through the electromagnet portion of the latching relay and thereby reversing the pivotal position of the movable iron pieces, and it is possible to retain a switched state with the magnetic force of the permanent magnet even after the passage of exciting current is stopped.

Further, according to the invention, as a configuration is adopted wherein the permanent magnet is sandwiched between the two bar-shaped iron pieces configuring the movable iron pieces of the electromagnet portion of the latching relay, it is possible to keep down the dimensions of the electromagnet portion even when the permanent magnet is increased in size, and thus possible to reduce the latching relay to a small size.

Also, in the invention, it is possible, in the condition in which the movable iron pieces are retained by the magnetic force of the permanent magnet, to increase the force of attracting the movable iron pieces with the permanent magnet by both the upper end of one iron piece of the movable iron pieces and the lower end of the other iron piece, or both the lower end of the one iron piece and the upper end of the other iron piece, always contacting with the magnetic pole pieces of both upper and lower ends of the fixed iron core 11, meaning that it is possible to stably carry out the retaining operation of the electrical contacts even when a small permanent magnet is used. Consequently, it is possible to suppress an occurrence of malfunction, such as an improper switching of the electrical contacts, even when an external force such as a vibration or impact is applied, and thus possible to enhance the reliability of the latching relay.

REFERENCE SIGNS LIST

1: Latching relay
2: Case
10: Electromagnet portion
11: Fixed iron core
11*a*, 11*b*: Magnetic pole piece
12: Coil bobbin
13: Exciting coil
14: Movable iron piece
15, 16: Bar-shaped iron piece
16*a*: Engagement piece
17: Permanent magnet
18: Holder made from insulating resin
18*a*: Pivotal support shaft
20: Electrical contact portion
21: Fixed terminal plate
22: Fixed contact
23: Movable terminal plate
24: Movable contact
25: Movable contact spring

What is claimed is:

1. A latching relay, comprising:

a fixed iron core having a substantially C-shape with side surfaces in a thickness direction thereof, and including an exciting coil wound around an intermediate portion and magnetic pole pieces extending outwardly from two ends of the intermediate portion to face each other;

movable iron pieces having two bar-shaped iron pieces spaced apart from and disposed parallel to each other, a permanent magnet sandwiched in a central portion between the two bar-shaped iron pieces, and an insulating resin holder for holding said bar shaped iron pieces and permanent magnet, said insulating resin holder having a support shaft extending in a direction perpendicular to longitudinal directions of the bar-shaped iron pieces; and a switchable electrical contact portion linked at one end to the movable iron pieces, wherein each of the magnetic pole pieces is disposed between end portions of the iron pieces with a space therebetween, respectively, such that the permanent magnet is held between the magnetic pole pieces, and the movable iron pieces are supported pivotally to rotate around the support shaft extending in a direction parallel to directions of the magnetic pole pieces extending from the intermediate portion so that the two bar-shaped iron pieces contact the side surfaces of the fixed iron core.

2. The latching relay according to claim 1, wherein slant surfaces are provided partially on at least either surfaces of the fixed iron core facing the movable iron pieces or surfaces of the movable iron pieces facing the fixed iron core.

3. The latching relay according to claim 1, wherein the insulating resin holder includes a pair of first flange portions spaced apart from each other in a width direction of the insulating resin holder and disposed on a central part of the insulating resin holder, and a pair of second flange portions spaced apart from each other in a longitudinal direction of the insulating resin holder and disposed on two end portions of the insulating resin holder, the pair of first flange portions being arranged perpendicular to the pair of second flange portions; and the permanent magnet is one magnet and is held in a space between the pair of first flange portions, and the two bar-shaped iron pieces are respectively held in a space between the pair of first flange portions and each of the pair of second flange portions to contact the permanent magnet.

4. The latching relay according to claim 3, wherein the support shaft extends outwardly from one surface of the insulating resin holder, and the pair of first flange portions and the pair of second flange portions extend from another surface of the insulating resin holder in a direction opposite to the support shaft.

* * * * *

UNITED STATES PATENT AND TRADEMARK OFFICE

CERTIFICATE OF CORRECTION

PATENT NO. : 8,823,473 B2
APPLICATION NO. : 13/885310
DATED : September 2, 2014
INVENTOR(S) : Ken Fujita et al.

It is certified that error appears in the above-identified patent and that said Letters Patent is hereby corrected as shown below:

In the Specification

Please change column 7, line 24, from "... iron core and..." to -- iron core 11 and --.

Please change column 8, lines 18 to 19, from "... iron core and..." to -- iron core 11 and --.

Please change column 10, line 67, from "... 11T formed by..." to -- 11'f formed by --.

Signed and Sealed this
Eighth Day of September, 2015

Michelle K. Lee

Michelle K. Lee
*Director of the United States Patent and Trademark Office*